United States Patent [19]

Ricci

[11] 4,344,562

[45] Aug. 17, 1982

[54] CENTRIFUGE CELL COLLECTOR APPARATUS

[76] Inventor: Andrew Ricci, 1450 E. 95th St., Brooklyn, N.Y. 11236

[21] Appl. No.: 181,230

[22] Filed: Aug. 25, 1980

Related U.S. Application Data

[63] Continuation-in-part of Ser. No. 8,384, Feb. 1, 1979, abandoned.

[51] Int. Cl.[3] ..... B04B 15/00

[52] U.S. Cl. ..... 233/26; 422/101

[58] Field of Search ..... 233/26, 27, 1 R, 1 A; 210/DIG. 23, DIG. 24, 516; 422/99, 100, 101, 102, 104

[56] References Cited

U.S. PATENT DOCUMENTS

| | | | |
|---|---|---|---|
| 3,081,029 | 3/1963 | Gauslaa | 233/26 |
| 3,170,838 | 2/1965 | Archer | 233/26 |

FOREIGN PATENT DOCUMENTS

| | | | |
|---|---|---|---|
| 565193 | 11/1932 | Fed. Rep. of Germany | 233/26 |
| 903384 | 2/1954 | Fed. Rep. of Germany | 233/26 |

*Primary Examiner*—Robert W. Jenkins

*Attorney, Agent, or Firm*—Michael J. Striker

[57] ABSTRACT

A conventional glass slide can be locked into a housing by means of a holder. Part of the housing is a reservoir in which a fluid sample may be received, the reservoir being closed off at its bottom by the glass slide when the glass slide has been locked into the housing. The invention allows centrifugation of small fluid samples to take place without any loss of cells, enhancing accuracy for purposes of medical diagnosis and treatment.

8 Claims, 2 Drawing Figures

CENTRIFUGE CELL COLLECTOR APPARATUS

CROSS-REFERENCE TO RELATED APPLICATION

This application is a continuation-in-part application of Ser. No. 8,384, filed Feb. 1, 1979 and now abandoned.

BACKGROUND OF THE INVENTION

1. Field of the Invention

This invention pertains to an apparatus which can be used to prepare sample slides from cell suspensions in a centrifuge.

2. Description of the Prior Art

Standard medical diagnostic procedures in fluid sample analysis can involve withdrawal of spinal, abdominal or pleural fluids from a patient in order to analyze such fluids for the presence of, e.g., cancer cells. Such fluids contain a relatively large amount of supernatant fluid in which the cells to be examined are suspended. It is critical to retain the maximum number of cells when separating them from the supernatant fluid in order to avoid the necessity of taking a second sample from a patient, or alternatively basing medical diagnosis and treatment upon a sample from which abnormal cells may have been lost.

Known methods of separating cells from the supernatant fluid in the sample involve either enhanced sedimentation of the sample through controlled diffusion into a filter paper, or centrifugation of the sample. In the former case, cell loss to the filter paper can arise, and a substantial sample size is required. In the latter case, a sample-containing tube is centrifuged, and the topmost layer of supernatant fluid is decanted, leaving the bottom fluid available for examination. Because this latter method involves the possibility of cell loss and also requires a relatively large sample size, it is also disadvantageous.

Moreover, neither of these two methods allows cells to be collected directly upon a conventional glass slide. Inasmuch as the cells collected from such samples are subjected to microscopic analysis, it would be advantageous to provide a device which would not only allow a relatively small sample to be withdrawn from a patient and which would allow all cells therein to be collected, but which would also allow these cells to be collected directly upon a conventional glass slide so that no intermediate transfer of collected cells thereto would be necessary prior to microscopic examination.

SUMMARY OF THE INVENTION

These objects, along with others which will become apparent hereinafter, are achieved in this invention by the provision of an apparatus which is designed to accommodate a conventional glass slide. Prior to introduction of the glass slide into the invention, the slide is coated with albumen so as to enable cells which are collected to adhere to the slide and not become dislodged therefrom when the slide is withdrawn. After such withdrawal, a fixative may be applied to the glass slide with the cells collected thereon, preventing any cell loss.

This invention utilizes a reservoir into which a sample of between 1 cc and 20 cc may be introduced. The reservoir is attached to a lower body and has an open bottom. The lower body includes a recess into which a conventional glass slide may be introduced in such a fashion that a portion of the surface of the glass slide closes off the open bottom of the reservoir. A seal, which may advantageously be an O-ring encircling the bottom of the reservoir, may be advantageously located in the lower body to prevent leakage around the glass slide during centrifugation.

A holder is detachably receivable within the lower body to lock the glass slide therein and thereby prevent the glass slide from falling out during centrifugation.

In operation, the sample introduced into the reservoir thus contacts the glass slide directly. The apparatus with the glass slide located therein is inserted into a centrifuge, and centrifuged. After centrifugation, all the cells in the sample are centrifugally forced onto the slide and adhere thereto by virtue of the albumen coating. After centrifugation is finished, the holder may be removed, thereby unlocking the glass slide and permitting it to be withdrawn with no loss of cells.

The invention finds utility in cellular analysis of any fluid sample. It completely prevents cell loss caused by decanting of supernatant fluid in which cells are contained or by transfer of cell-containing fluid from a centrifuged sample onto a slide for examination. Smaller samples can be used and accurately evaluated, allowing smaller samples to be taken from patients and obviating the necessity for subsequent withdrawal of fluids from a patient because of cell loss in a prior glass slide preparation. Medical diagnosis and treatment can proceed from a well-grounded microscopic analysis.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF PREFERRED EMBODIMENTS

Figure 1:
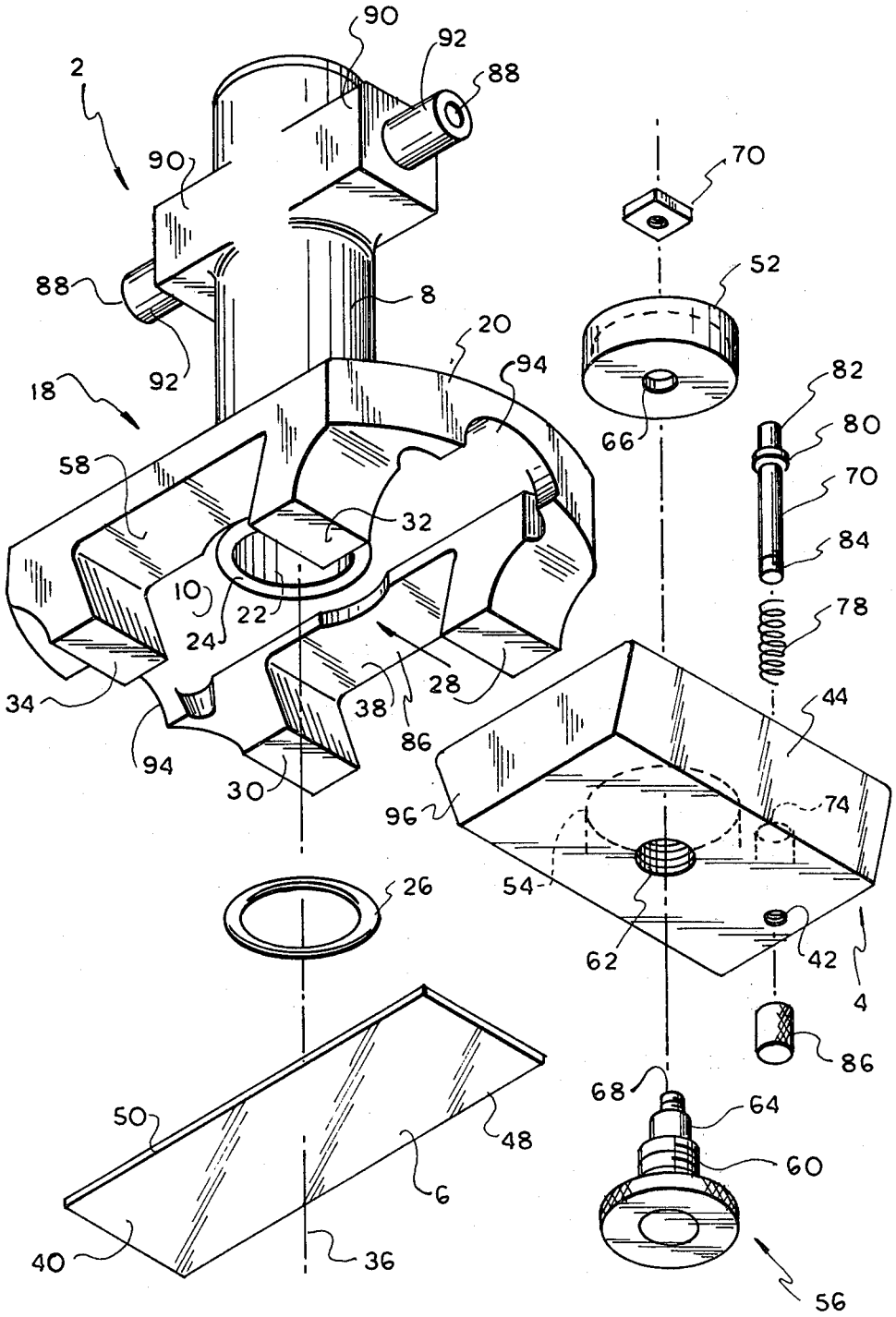
FIG. 1 shows an exploded perspective view of the invention.
Figure 2:
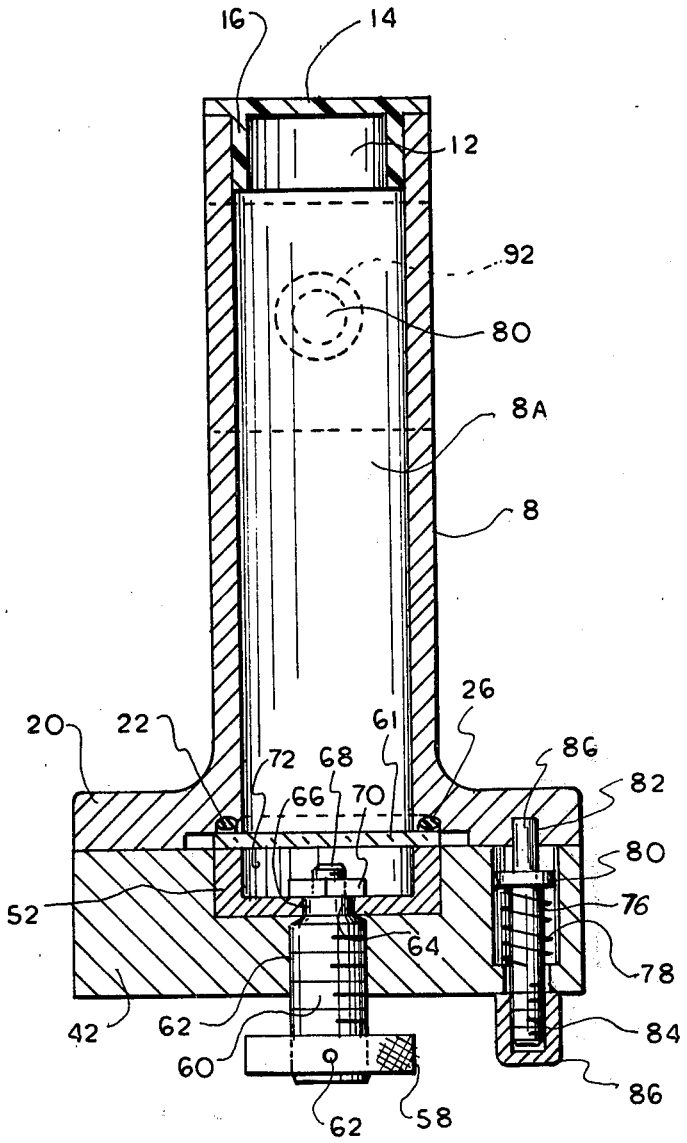
FIG. 2 shows an elevational view through the center of the invention as viewed from its side.

This invention includes a housing which is generally indicated by reference numeral 2 in FIG. 1, along with a holder generally indicated by reference numeral 4 in the same Figure. Holder 4 can lock in a conventional glass slide 6 or other suitable substrate accommodated within housing 2, in order to allow cells to be collected on the slide during centrifugation.

A vertically elongated reservoir 8 is shaped into the form of a hollow cylinder with an open bottom 10 and an open top 12. Inside surface 8A of reservoir 8 is machined to a highly smooth surface, to prevent any possibility that cells will adhere thereto and will thereby be prevented from being centrifuged onto glass slide 6, as is described below. Top 12 may be closed off by a plastic cap 14 or other suitable closure to prevent any possibility of contamination entering top 12. Cap 14 has a downwardly extending annular collar 16 which bears against the interior of reservoir 8 so as to firmly secure cap 14 thereon.

At the lower end of reservoir 8 is located a lower body which is generally indicated by reference numeral 18. Lower body 18 is integrally formed with reservoir 8 and both may advantageously be cast together in a single casting. Lower body 18 has a horizontal plate 20 which surrounds bottom 10 of reservoir 8, so that bottom 10 opens through plate 20. A rectangular recess 22 which is shaped to accommodate glass slide 6 is cut into plate 20 so that fluid in reservoir 8 may come into contact with glass slide 6. To prevent leakage during centrifugation, annular groove 24 is cut into plate 20 around bottom 10 of reservoir 8, and an elastomeric O-ring 26 may be introduced in groove 24. As will be seen hereinafter, leakage around glass slide 6 will be prevented because glass slide 6 is urged against O-ring 26 during use. Advantageously, O-ring 26 may be made of rubber.

First projection 28, second projection 30, third projection 32, and fourth projection 34 are unitary with plate 20 and project downwardly therefrom. Projections 28, 30, 32, and 34 define a channel into which holder 4 may be detachably received. Projections 28, 30, 32, and 34 are offset around a central axis 36 and are inclined theretowards, so that the channel formed between them is trapezoidal in cross-section. The channel is so shaped that its bottom surface 38 is located below and bifurcated by recess 22. As a result, a bottom surface 40 of glass slide 6 will be aligned with surface 38 when glass slide 6 is locked into recess 22.

Holder 4 has an elongated element 42 having a length which is equal to the width of plate 20. Element 42 is trapezoidal in cross-section so as to mate with the channel defined between projections 28, 30, 32, and 34. As can be seen in FIG. 1, when element 42 is received within the channel, first and third projections 28 and 32 will abut a first side 44 of element 42, while second and fourth projections 30 and 34 will abut a second side 46 of element 42. Hence, it can be seen that when element 42 is received within the channel, it will be oriented perpendicularly to glass slide 6, which latter, when accommodated in recess 22, will have its first side 48 adjoined by first and second projections 28 and 30 and will have its second side 50 adjoined by third and fourth projections 32 and 34.

As mentioned above, holder 4 is designed to lock glass slide 6 into housing 2. To cause such locking to take place, element 42 supports an adjustable movable block 52 which generally takes the shape of a thick circular disk. Block 52 is received within cylindrical recess 54 located in element 42, and block 52 is attached to a knob generally indicated by reference number 56 in the drawing.

Knob 56 has a knurled head 58 which is attached to a threaded shaft section 60 by means of set screw 62. Shaft section 60 is threaded into tapped hole 62 in element 42, so as to move in and out of element 42 when head 58 is rotated. Unthreaded shaft section 64 is smaller in diameter than shaft section 60, and is located within hole 66 which is located in the center of block 52. Threaded end 68 of the shaft supports nut 70 which is threaded on. Nut 70 is located within a cylindrical recess 72 which is cut into block 52 and has an open top that faces towards glass slide 6.

It will be clear that block 52 is not fixed to the shaft formed by shaft sections 60 and 64 and 68, but is rather pivotably secured thereto so as to move as the shaft is rotated. As head 58 is rotated, block 52 will be forced inwardly against glass slide 6, pressing against surface 40 and urging glass slide 6 against O-ring 26. This tends to force element 42 away from plate 20, but separation of element 42 and lower body 18 is prevented by the inclination of projections 28, 30, 32 and 34.

Element 42 is recessed at elongated cylindrical recess 74 in order to accommodate elongated locking pin 76. Locking pin 76 has an annular collar 80, which is located adjacent unthreaded end 82. Opposite unthreaded end 82 is threaded end 84. When locking pin 76 is installed in element 42, helical compression spring 78 is held between collar 80 and element 42, and locking pin 76 is retained within element 42 because threaded cap 86 is threaded onto threaded end 84. When cap 86 is grasped and pulled away from element 42, locking pin 76 is withdrawn into element 42 against the pressure of spring 78. This allows element 42 to be introduced into the channel defined between projections 28, 30, 32, and 34. After element 42 has been properly positioned, cap 86 may be released so that unthreaded end 82 of locking pin 76 can be forced into cylindrical hole 86 located in surface 38 between first projection 28 and second projection 30. This prevents element 42 from being improperly positioned, and allows block 52 to be aligned with and located below O-ring 26, so that when head 58 is rotated, glass slide 6 will have pressure applied evenly thereto and will not break by virtue of any displacement between block 52 and O-ring 26. It will be appreciated that in the event care is taken to properly position element 42, locking pin 76 and components associated therewith are not absolutely necessary to the practice of this invention, but are provided only for the sake of convenience.

Adjacent the top of reservoir 8, two diametrically opposed and radially outwardly extending cylindrical studs 88 are each supported by a radially outwardly extending shoulder 90. Studs 88 may advantageously be surrounded by cylindrical brass sheaths 92 which can serve as bearings.

In use, a glass slide 6 is accommodated within recess 22, and can easily be placed therein and removed therefrom because plate 20 has circular openings 94 at its ends which allow glass slide 6 to be grasped. Glass slide 6 has been previously coated with albumen at its center, to allow cells centrifuged out of supernatant fluid to adhere to glass slide 6. After glass slide 6 has been accommodated in recess 22, head 58 is rotated fully counterclockwise, causing block 52 to be fully withdrawn into element 42. Cap 86 is pulled, and element 42 can then be received within the channel formed by projections 28, 30, 32, and 34. Cap 86 is then released, causing unthreaded end 82 of locking pin 76 to be received within hole 86 and thus causing element 42 to be secured within the channel. Head 58 is then rotated counterclockwise, pressing the glass slide 6 against O-ring 26 to lock glass slide 6 into recess 22 and thereby prevent it from moving.

Next, a fluid sample is introduced into reservoir 8, in any suitable amount which will typically vary between 1 cc and 20 cc. Cap 14 is then installed on reservoir 8 to eliminate any possibility of spillage. Housing 2 is then attached to a centrifuge (not shown), with sheaths 92 serving as bearings and with studs 88 holding housing 2 in such a fashion that housing 2 may swing outwardly as the centrifuge is rotated. After a suitable period of centrifugation, which typically will be 15 minutes at 1500 revolutions per minute, any cells which are contained within the sample will be centrifuged onto glass slide 6 and adhered thereto by the albumin. Subsequently, housing 2 may be removed from the centrifuge, cap 14 may be removed to allow the supernatant fluid to be decanted, head 58 can be rotated counterclockwise to loosen element 42 and glass slide 6, and cap 86 may be moved away from element 42 to permit holder 4 to be removed from housing 2. Glass slide 6 can then be removed, in order to allow cells centrifuged thereupon to be fixed with a suitable fixing agent.

It will be understood that each of the elements described above, or two or more together, may also find a useful application in other types of constructions differing from the types described above.

While the invention has been illustrated and described as embodied in a centrifuge cell collector apparatus, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An apparatus for the preparation of samples for microscopic examination by deposition of centrifuged cells upon a conventional glass slide, comprising: a hollow elongated reservoir with an open bottom and an open top; a lower body attached to the bottom of the reservoir and having a recess for accommodating a conventional glass slide transversely to the reservoir to cause the slide to abut the open bottom thereof, said body having first, second, third and fourth projections integral with the lower body and extended downwardly therefrom and arranged to form a channel between said projections; an elongated holder adapted to slide into and out of said channel and cooperating with the lower body so that said holder is detachably received therein to lock a slide in said body and to allow a slide to be removed from said lower body; and studs attached to the housing near its top for detachably securing the reservoir to a centrifuge, the projections being so located that the first and third projections will be adjacent a first side of the holder and the second and fourth projections will be adjacent a second side of the holder when the holder is received in the channel, and further being so located that the first and second projections will be adjacent a first side of the slide and the third and fourth projections will be adjacent a second side of the slide when the slide is accommodated in the recess.

2. The apparatus defined by claim 1, wherein the channel has a trapezoidal cross-section.

3. The apparatus defined by claim 1, wherein the projections are offset from a central axis of the apparatus and are inclined towards the axis, whereby a channel between the projections is defined within which the holder is constrained to move in only one direction when slipped into and out of the channel.

4. The apparatus defined by claim 3, wherein the projections define a channel with a trapezoidal cross-section, and wherein the holder has a trapezoidal cross-section which mates with the channel.

5. The apparatus defined by claim 1, wherein the holder is detachably received within the channel by a spring-loaded locking pin.

6. The apparatus defined by claim 1, wherein the holder includes an adjustable movable block, said block urging the slide against a seal located within the lower body to prevent leakage.

7. The apparatus defined by claim 1, further including a seal located within the lower body and abutting the slide accommodated in the recess, whereby leakage from the reservoir around the slide is prevented.

8. The apparatus defined by claim 7, wherein the seal is an elastomeric O-ring encircling the bottom of the reservoir.

* * * * *